US005636879A

United States Patent [19]

Tanaka et al.

[11] Patent Number: 5,636,879

[45] Date of Patent: Jun. 10, 1997

[54] COUPLING STRUCTURE BETWEEN DOOR LOCK AND DOOR LOCK-ACTUATOR

[75] Inventors: Masaki Tanaka; Masaru Inoue, both of Yokohama, Japan

[73] Assignee: Jidosha Denki Kogyo Kabushiki Kaisha, Yokahama, Japan

[21] Appl. No.: 179,226

[22] Filed: Jan. 10, 1994

[30] Foreign Application Priority Data

Jan. 11, 1993 [JP] Japan ..... 5-000404 U

[51] Int. Cl.[6] ..... E05C 19/00

[52] U.S. Cl. ..... 292/2; 292/216; 292/DIG. 23

[58] Field of Search ..... 292/2–5, 7, 12, 292/22, 142, 144, 201, 216, 337, DIG. 323, DIG. 43

[56] References Cited

U.S. PATENT DOCUMENTS

| | | | |
|---|---|---|---|
| 1,782,386 | 11/1930 | Moore et al. | 292/2 X |
| 2,225,545 | 12/1940 | Brantingson | 292/2 X |
| 2,379,050 | 6/1945 | Voight | 292/5 |
| 2,569,043 | 9/1951 | Endter | 292/2 X |
| 2,683,616 | 7/1954 | Baker | 292/7 |
| 4,196,925 | 4/1980 | Torii | 292/DIG. 23 X |
| 4,762,348 | 8/1988 | Matsumoto | 292/DIG. 23 X |
| 4,814,557 | 3/1989 | Kato | 292/216 X |
| 4,904,006 | 2/1990 | Hayakawa et al. | 292/216 X |

*Primary Examiner*—Suzanne L. Dino

*Attorney, Agent, or Firm*—Sughrue, Mion, Zinn, Macpeak & Seas

[57] ABSTRACT

Coupling structure between a door lock and a door lock-actuator includes a pair of projecting arms disposed to an output shaft of the door lock-actuator and protruding radially, and two swing arms provided to a lock lever of the door lock and contacting with the respective projecting arms of the output shaft of the door lock-actuator. According to the coupling structure, the door lock-actuator can be coupled with the door lock without adjusting the positions of the output shaft and the lock lever with each other in advance and the work efficiency is improved for the installation.

3 Claims, 5 Drawing Sheets

COUPLING STRUCTURE BETWEEN DOOR LOCK AND DOOR LOCK-ACTUATOR

BACKGROUND OF THE INVENTION

1. Field of the Invention

This invention relates to a coupling structure between a door lock and a door lock-actuator used for locking or unlocking a door of a vehicle electrically according to a switch operation by coupling the door lock and the door lock-actuator for actuating the door lock, and more particularly to coupling structure between an output shaft of the door lock-actuator and a lock lever of the door lock.

2. Description of the Prior Art

Heretofore, the aforementioned door lock and the door lock-actuator have been coupled as shown in FIG. 3, for example.

Namely, FIG. 3 is an illustration showing a system for opening and closing a door D of the vehicle, the opening and closing system is provided with a door lock 50, a door lock-actuator 60, an outside handle H, an inside handle (not shown) and a lock knob (not shown), and the door lock 50 is provided with a latch 51 to be engaged with a striker (not shown) disposed on a vehicle body.

The outside handle H and the inside handle are connected with the door lock 50 through an outside handle rod 31 and an inside handle rod 32. The operation of the outside handle H or the inside handle is transmitted to the door lock 50 through the rod 31 or 32 and the door D is so structured as to be opened by disengagement of the latch 51 engaged with the striker of the vehicle body.

The door lock 50 is provided with a lock lever 52 for restricting the movement of the latch 51 and locking the door D according to the swing in the counterclockwise direction in the figure. The lock lever 52 is connected to a key cylinder K through a key rod 33, and connected to the lock knob through a bell crank B, a first and a second lock rods 34 and 35, and the door D is locked or unlocked by a key-operation from the outside of the vehicle or by an operation of the lock knob from the inside of the vehicle.

The door lock-actuator 60 is provided with a small-sized D.C. motor and a reduction gear in a casing, is designed so as to output the bi-directional rotation of the motor reductively as a reciprocative rotation of an output shaft 61 and disposed with a swing arm 62 on the output shaft. The door lock-actuator 60 is positioned so that the end of the swing arm 62 may be engaged to a cutout 52*a* formed in the lock lever 52 of the door lock 50, and the door D is so designed as to be locked or unlocked according to the angular rotation of the swing arm 62 in the clockwise or counterclockwise direction on the basis of the forward or reverse directional rotation of the small-sized motor in addition to the operation of the key or the lock knob. Therefore, it is possible to lock or unlock all the doors of the vehicle collectively by operating a door lock switch disposed on the side of the driver's seat, and possible to lock the doors automatically in combination with a car-speed sensor when the vehicle starts to run.

However, in the conventional coupling structure between the door lock and the door lock-actuator, at the time of mounting the door lock-actuator 60 in the door D, it is required to couple the swing arm 62 of the door lock-actuator 60 with the lock lever 52 of the door lock 50 in a state where the end of the swing arm 62 is engaged to the cutout 52*a* of the lock lever 52, accordingly, it is necessary to set in advance the positions of the swing arm 62 and the lock lever 52 so that the end of the swing arm 62 may fit to the cutout 52*a* of the lock lever 52.

Namely, in the case where the lock lever 52 of the door lock 50 sits at the position as shown in FIG. 4, it is not possible to engage the end of the swing arm 62 in the cutout 52*a* of the lock lever 52. Accordingly, it is necessary to previously shift the lock lever 52 to the position shown with two-dot chain lines from the position shown with solid lines (naturally, the swing arm 62 may be shifted toward the lower side in the figure).

As mentioned above, in the conventional coupling structure between the door lock and the door lock-actuator, there is a problem in that it is troublesome to install the door lock-actuator 60 in the door D and is required much labor because it is necessary to make the positions of the swing arm 62 of the door lock-actuator 60 and the lock lever 52 of the door lock 50 coincide with each other previous to the coupling of the door lock 50 and the door lock-actuator 60.

SUMMARY OF THE INVENTION

This invention is made in view of the above mentioned problem of the prior art in the case of mounting the door lock-actuator in the door of motor vehicles with the object of providing coupling structure between a door lock and a door lock-actuator which is possible to couple the door lock and the door lock-actuator very easily independently of the positional relation between the lock lever of the door lock and the output member, and possible to transmit the output of the door lock-actuator smoothly to the door lock.

The construction of the coupling structure between the door lock and the door lock-actuator according to this invention for accomplishing the above-mentioned object is characterized in that an output shaft of the door lock-actuator is provided with a pair of projecting arms protruding radially in different directions from each other, and a lock lever of the door lock is provided with two swing arms to be in contact with the respective projecting arm of the output shaft of the door lock-actuator.

In the coupling structure between the door lock and door lock-actuator according to this invention, the pair of projecting arms protruding in the different directions from the center of the output shaft are disposed on the output shaft of the door lock actuator, and two swing arms to be in contact respectively with both the projecting arms of the output shaft are provided on the lock lever of the door lock. Therefore, it is not necessary to shift the output shaft or the lock lever according to the position of the lock lever of the door lock or the output shaft of the door lock-actuator in advance of the installation of the door lock-actuator because the projecting arms of the output shaft of the door lock-actuator make contact with the swing arms of the lock lever of the door lock respectively by merely pushing the door lock-actuator against the door lock. Furthermore, according to an angular rotation of the output shaft of the door lock-actuator, the projecting arms of the output shaft in contact with the swing arms of the lock lever presses the swing arms and gives an angular rotation to the lock lever in the same direction as the output shaft of the door lock-actuator, therefore, the door is locked or unlocked very smoothly in accordance with the actuation by the door lock-actuator.

DESCRIPTION OF THE PREFERRED EMBODIMENT

This invention will be concretely described below on basis of the drawings.

Figure 1:
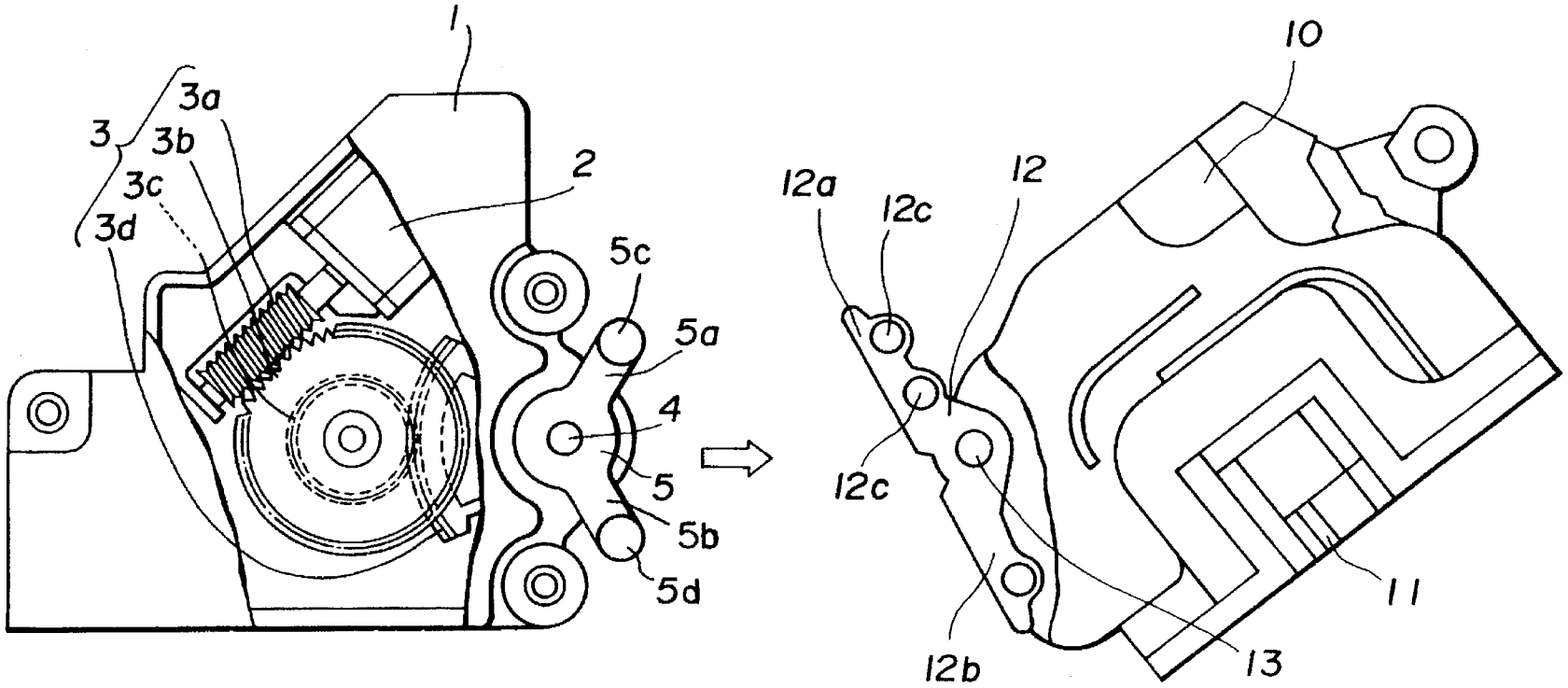
FIG. 1 is an illustration showing the coupling structure between the door lock and the door lock-actuator according to an embodiment of this invention.
Figure 2A:
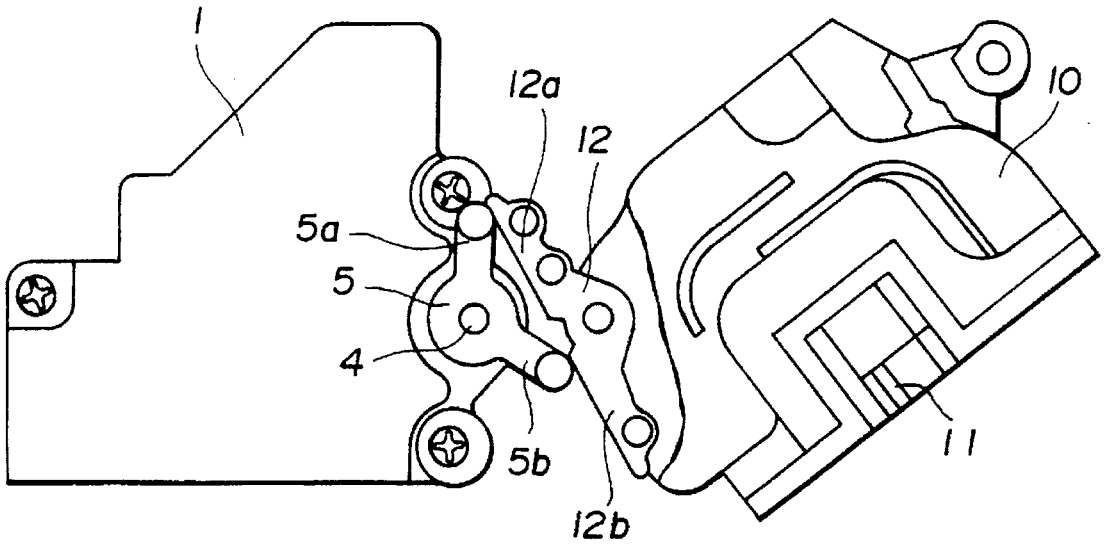
FIG. 2A and FIG. 2B are illustrations explaining the working states of the door lock and the door lock-actuator connected by the coupling structure shown in FIG. 1, respectively.
Figure 2B:
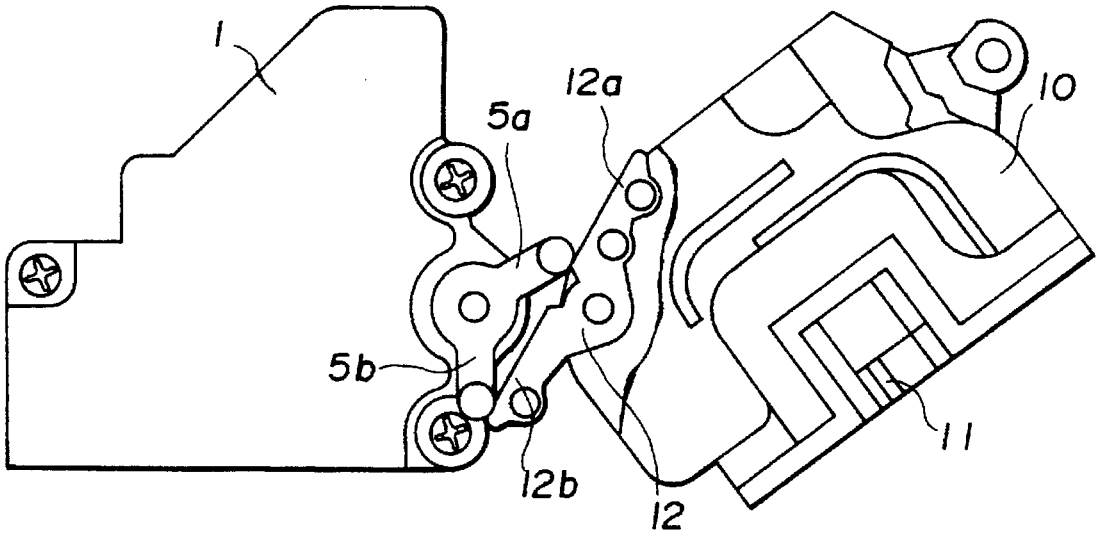

FIG. 1 and FIG. 2A, FIG. 2B are illustrations explaining the coupling structure between the door lock and the door lock-actuator according to an embodiment of this invention, a door lock-actuator 1 shown on the left side in FIG. 1 is provided in its casing with a small-sized D.C. motor 2 and a reduction gear 3 comprising a worm 3*a* formed on a motor shaft of the D.C. motor 2, a worm wheel 3*b* meshed with the worm 3*a*, a pinion 3*c* secured co-axially on the worm wheel 3*b* and a sector wheel 3*d* meshed with the pinion 3*c*, and the door lock-actuator 1 is so designed as to output reciprocative rotational movement of an output shaft 4 secured to the sector wheel 3*d* in a clockwise or counterclockwise direction by reducing the forward or reverse directional rotation of the D.C. motor 2 depending on the current direction supplied from external wires (not shown) through the reduction gear 3.

The output shaft 4 of the door lock-actuator 1 is secured with an output lever 5 having a pair of projecting arms 5*a*, 5*b* protruding radially from the axial center thereof and making an angle of approximately 120 degree from each other in this embodiment, and the projecting arms 5*a*, 5*b* are so formed as to make contact with swing arms 12*a*, 12*b* of a lock lever 12 of a door lock 10, which will be described later, and to transmit the output of the door lock-actuator 1 to a door lock 10.

On the other side, the door lock 10 is provided with a mechanism substantially similar to the door lock 50 shown in FIG. 5 as represented by a latch 11 to be engaged to the striker disposed on the vehicle body excepting a shape of a lock lever 12. The door lock 10 is connected with the outside handle, the inside handle, the key cylinder and the lock knob through rods which are not shown, and structured so as to fulfill the functions for opening, closing, locking or unlocking the door similarly to the aforementioned door lock The lock lever 12 is installed on the door lock 10 rotatably in a range of about 60 degree around a shaft 13, and the door lock 10 is so designed as to restrain a movement of the latch 11 for locking the door by turning the lock lever 12 swingingly in the counterclockwise direction and as to release the restraint of the latch 11 for unlocking the door by turning the lock lever 12 in the clockwise direction. The lock lever 12 is provided with swing arms 12*a* and 12*b* extending toward the both sides from the shaft 13 and making contact with the respective projecting arms 5*a* and 5*b* of the output lever 5 secured to the output shaft 4 of the door lock-actuator 1 at contact surfaces being on the same plane, and the arms 12*a* and 12*b* are formed with rod holes 12*c* for joining respective rods connected to the key cylinder, the lock knob and so on.

At the time of incorporating the door lock 10 and the door lock-actuator 1 provided with the lock lever 12 and the output lever 5 having such a configuration, it is possible to couple the output lever 5 to the lock lever 12 independently of the positions of the lock lever 12 and the output lever 5 by only sliding the door lock-actuator 1 in the direction of pressing the output lever 5 against the lock lever 12 of the door lock 10 mounted in the door.

Namely, in the case where the lock lever 12 of the door lock 10 sits on the locking position as shown in FIG. 1, the projecting arm 5*a* of the output lever 5 of the door lock-actuator 1 on the upper side in the figure comes in contact with the swing arm 12*a* of the lock lever 12 at the first place and the output lever 5 turns in the counterclockwise direction. Then, the door lock 10 and the door lock-actuator 1 are coupled in the state as shown in FIG. 2A by sliding the door lock-actuator 1 toward the door lock 10 until the projecting arm 5*b* of the output shaft S on the lower side in the figure comes in contact with the other swing arm 12*b* of the lock lever 12. Contrary to above, in the case where the lock lever 12 of the door lock 10 sits in the unlocking position, the projecting arm 5*b* of the output lever 5 of the door lock-actuator 1 on the lower side in the figure comes in contact with the other swing arm 12*b* of the lock lever 12, and the upper projecting arm 5*a* of the output lever 5 comes in contact with the swing arm 12*a* of the lock lever 12 by the angular rotation of the output lever 5 in the clockwise direction, then the door lock 10 and the door lock-actuator 1 are coupled in the state as shown in FIG. 2B.

At the time of switching the door lock 10 into the unlocked state from the locked state as shown in FIG. 2A using the door lock-actuator 1 coupled in such a manner, the angular rotation in the clockwise direction is given to the output shaft 4 of the door lock-actuator 1 by supplying an electric current in the predetermined direction to the motor 2 of the actuator 1 through the external wires (not shown).

Whereby, the projecting arm 5*a* of the output lever 5 secured to the output shaft 4 of the door lock-actuator 1 presses the swing arm 12*a* of the lock lever 12 of the door lock 10, the angular rotation is given to the lock lever 12 in the clockwise direction and the door lock 10 is switched into the unlocked state in consequence of the movement of the lock lever 12 to the position as shown in FIG. 2B. Conversely, in order to switch the door lock 10 to the locked state from the unlocked state as shown in FIG. 2B, the angular rotation is given to the output shaft 4 of the door lock-actuator 1 in the counterclockwise direction by supplying an electric current to the motor in the reverse direction. Whereby, the projecting arm 5*b* of the output lever 5 secured to the output shaft 4 presses the swing arm 12*b* of the lock lever 12 of the door lock 10 and shifts the lock lever 12 into the position as shown in FIG. 2A by rotating the lock lever 12 swingingly in the counterclockwise direction. Consequently, the door lock 10 is switched into the locked state.

Figure 2C:
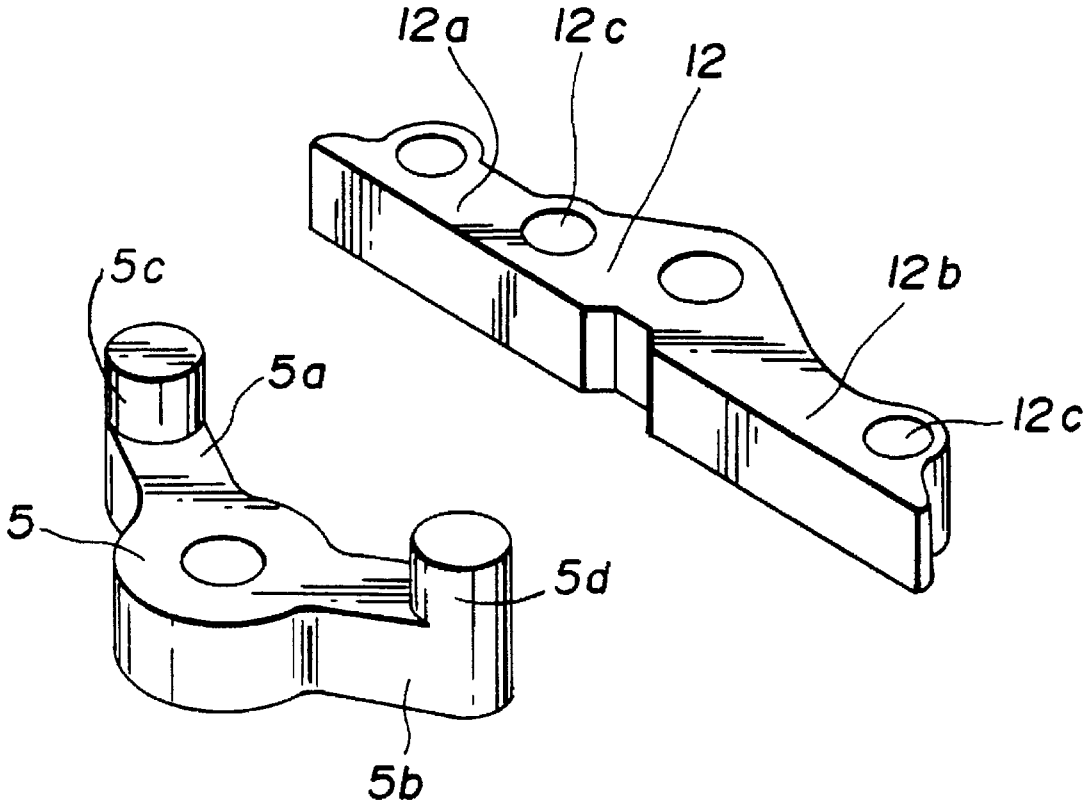
FIG. 2C is a perspective view illustrating shapes of the lock lever of the door lock and the output lever of the door lock-actuator shown in FIG. 1.
Figure 3:
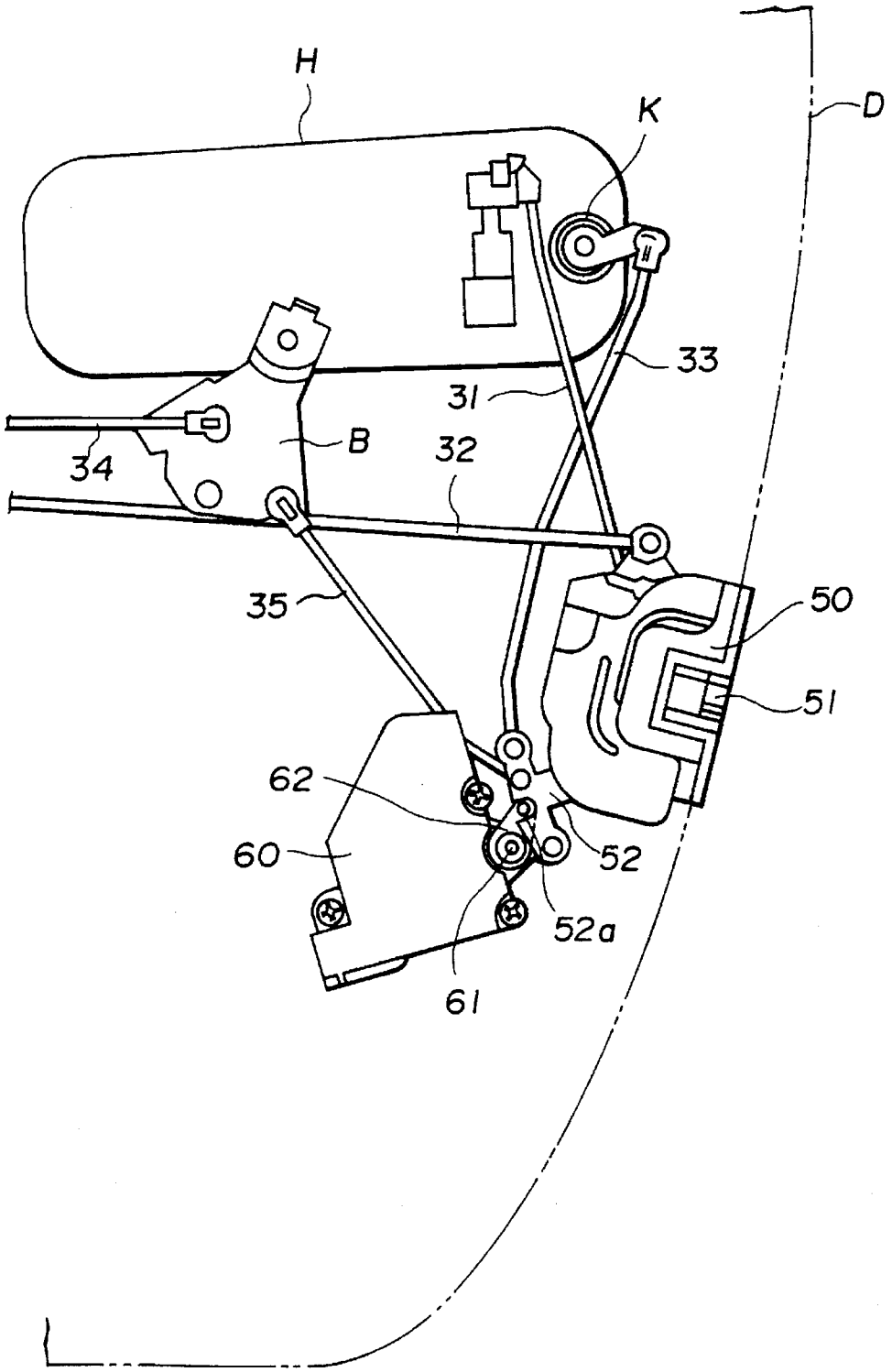
FIG.3 (PRIOR ART)
FIG. 3 is an illustration showing the opening and closing system for the door having the door lock and the door lock-actuator connected by the conventional coupling structure.
Figure 4:
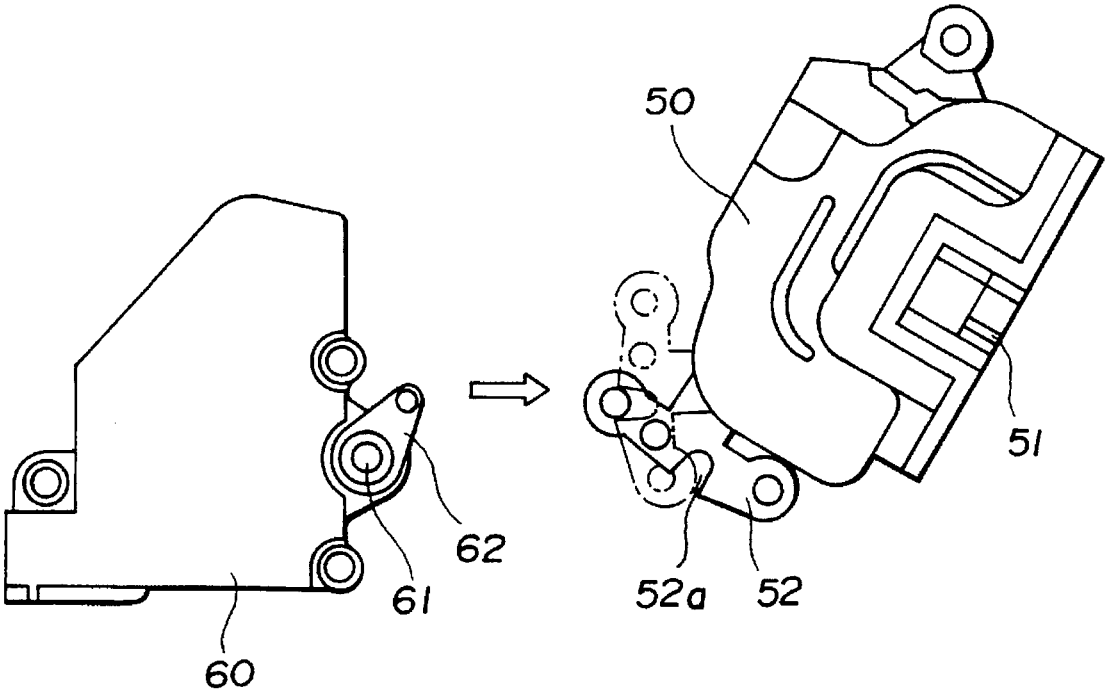
FIG.4 (PRIOR ART)
FIG. 4 is an illustration showing the conventional coupling structure between the door lock and the door lock-actuator of the opening and closing system for the door shown in FIG. 3.

Additionally, FIG. 2C is a perspective view showing shapes of the lock lever 12 of the door lock 10 and the output lever 5 of the door lock-actuator 1, the output lever 5 is provided with small cylindrical protrusions 5*c* and 5*d* on the respective ends of the projecting arms 5*a* and 5*b* in order to ensure the contact between the lock lever 12 and the output lever 5.

As mentioned above, in the coupling structure between the door lock and the door lock-actuator according to this invention, it is possible to transmit the output of the door lock-actuator securely to the door lock and it is not necessary to adjust the positions of the output shaft of the door lock-actuator and the lock lever of the door lock with each other in advance of the coupling of the door lock and the door lock-actuator. Therefore, an excellent effect can be obtained in that it is possible to simplify and facilitate the installation of the door lock and the door lock-actuator in the door of the motor vehicle, and possible to improve the work efficiency for the installation.

What is claimed is:

1. A combination of a door lock actuator and a door lock for a vehicle comprising:

a) said door lock including a lock lever pivotally supported on a shaft, said lock lever having a pair of first and second swing arms disposed in opposition to each other, and b) said door lock actuator including an electric reversible motor, a reduction gear driven by the motor and a V-shaped output lever connected for movement with said reduction gear, said output lever having a pair of first and second projecting arms, said first projecting arm being oppositely disposed adjacent to said first swing arm of said lock lever of said door lock and said second projecting arm being oppositely disposed adjacent to said second swing arm of said lock lever of said door lock, whereby said first projecting arm of said output lever of said door lock actuator comes in contact with said first swing arm of said lock lever of said door lock when the electric reversible motor rotates in the forward direction and said second projecting arm of said output lever of said door lock actuator comes in contact with said second swing arm of said lock lever of said door lock when the electric reversible motor rotates in the reverse direction.

2. A combination of claim 1, in which each of said first and second projecting arms has a cylindrical protrusion on an end portion thereof.

3. In a door lock system of a vehicle, the combination comprising:

a) a door lock including a lock lever pivotally supported on a shaft, said lock lever having a pair of first and second swing arms disposed in opposition to each other, and b) a door lock actuator including a reversible motor provided with a worm formed on a shaft thereof, a reduction gear provided with a worm wheel meshed with the worm of said motor, a pinion secured co-axially on the worm wheel and a sector wheel meshed with the pinion, and an output lever secured for movement with the sector wheel, said output lever having a pair of first and second projecting arms, said first projecting arm being oppositely disposed adjacent to said first swing arm of said lock lever of said door lock and said second projecting arm being oppositely disposed adjacent to said second swing arm of said lock lever of said door lock, whereby said first projecting arm of said output lever of said door lock actuator comes in contact with said first swing arm of said lock lever of said door lock when the electric reversible motor rotates in the forward direction and said second projecting arm of said output lever of said door lock actuator comes in contact with said second swing arm of said lock lever of said door lock when the electric reversible motor rotates in the reverse direction.

* * * * *